US009981395B2

(12) United States Patent
Liu

(10) Patent No.: US 9,981,395 B2
(45) Date of Patent: May 29, 2018

(54) KNIFE HANDLE WITH REMOVABLE COUNTERWEIGHTS

(71) Applicant: Chia-Ming Liu, Douliou (TW)

(72) Inventor: Chia-Ming Liu, Douliou (TW)

( * ) Notice: Subject to any disclaimer, the term of this patent is extended or adjusted under 35 U.S.C. 154(b) by 0 days. days.

(21) Appl. No.: 15/658,454

(22) Filed: Jul. 25, 2017

(65) Prior Publication Data

US 2018/0056531 A1 Mar. 1, 2018

Related U.S. Application Data

(63) Continuation-in-part of application No. 15/352,880, filed on Nov. 16, 2016.

(30) Foreign Application Priority Data

Aug. 29, 2016 (CN) ..... 2016 2 0963276 U
Apr. 24, 2017 (CN) ..... 2017 2 0433400 U

(51) Int. Cl.
*B26B 3/00* (2006.01)
*B25G 1/00* (2006.01)

(52) U.S. Cl.
CPC . *B26B 3/00* (2013.01); *B25G 1/00* (2013.01)

(58) Field of Classification Search
CPC .. B26B 3/00; B26B 11/00; B26B 5/00; B35G 11/00
USPC ..... 30/125, 340, 342, 343, 344; 16/111.1, 16/404, 902; 453/54
See application file for complete search history.

(56) References Cited

U.S. PATENT DOCUMENTS 663,290 A * 12/1900 Miller ..... 453/54
723,600 A * 3/1903 Grover ..... 453/54
1,492,381 A * 4/1924 Lindenmayer ..... A45C 1/024 132/299
4,828,266 A * 5/1989 Tunstall ..... A63B 53/0487 473/336
6,419,371 B1 * 7/2002 McCalla ..... B25B 23/18 362/109
2009/0158600 A1 * 6/2009 Ishai ..... B25G 1/00 30/314
2012/0056812 A1 * 3/2012 Chan ..... G06F 3/03543 345/163
2016/0016057 A1 * 1/2016 Wang ..... A63B 53/14 473/297

* cited by examiner

*Primary Examiner* — Andrea Wellington
*Assistant Examiner* — Samuel A Davies
(74) *Attorney, Agent, or Firm* — Trop Pruner & Hu, P.C.

(57) ABSTRACT

A knife includes a blade, and a counterweight unit, and a handle having an accommodating space. The counterweight unit includes a counterweight-receiving member removably disposed in the accommodating space, multiple counterweights, and a biasing member. The counterweight-receiving member has a tubular wall, and an abutment wall cooperating with the tubular wall to define a receiving space and defining an exit opening that spatially communicates with the receiving space. The counterweights are removably disposed in the receiving space. The biasing member biases the counterweights toward the abutment wall so as to permit removal of one of the counterweights via the exit opening when the counterweight unit is separated from the handle.

8 Claims, 4 Drawing Sheets

KNIFE HANDLE WITH REMOVABLE COUNTERWEIGHTS

CROSS-REFERENCE TO RELATED APPLICATION

This application is a continuation-in-part (CIP) of co-pending U.S. patent application Ser. No. 15/352,880, filed on Nov. 16, 2016, which claims priority of Chinese Utility Model Patent Application No. 201620963276.4, filed on Aug. 29, 2016. This application also claims priority of Chinese Utility Model Patent Application No. 201720433400.0, filed on Apr. 24, 2017.

FIELD

The disclosure relates to a knife, and more particularly to a knife with a variable number of counterweights.

BACKGROUND

A conventional knife, especially a fine-quality kitchen knife, is typically manufactured with a fixed weight distribution. Since kitchen knife is used for long hours daily, it has to be sharpened almost on a day-to-day basis. After being repeatedly sharpened, the center of mass of the kitchen knife will shift rearward, which adversely affect comfort of use and performance of the knife.

SUMMARY

Therefore, an object of the disclosure is to provide a knife with adjustable weight distribution.

According to the disclosure, the knife includes a handle, a blade, and a counterweight unit.

The handle extends along an axis, and has a front end portion, a rear end portion that is opposite to the front end portion, and an accommodating space that extends from the rear end portion toward the front end portion.

The blade is connected to the front end portion of the handle.

The counterweight unit includes a cover seat, a counterweight-receiving member, a plurality of counterweights, and a biasing member. The cover seat is removably connected to the rear end portion of the handle. The counterweight-receiving member is removably disposed in the accommodating space, and has a tubular body having a connecting end which is connected to the cover seat, and a distal end which is opposite to the connecting end along the axis. The counterweight-receiving member further has an abutment wall that extends from the distal end of the tubular body away from the connecting end, that cooperates with the tubular body to define a receiving space, and that defines an exit opening extending in a radial direction perpendicular to the axis and spatially communicating with the receiving space. The counterweights are removably disposed in the receiving space. The biasing member is disposed in the counterweight-receiving member, and biases the counterweights toward the abutment wall so as to permit removal of one of the counterweights which is adjacent to the abutment wall via the exit opening in the radial direction when the counterweight unit is separated from the handle.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
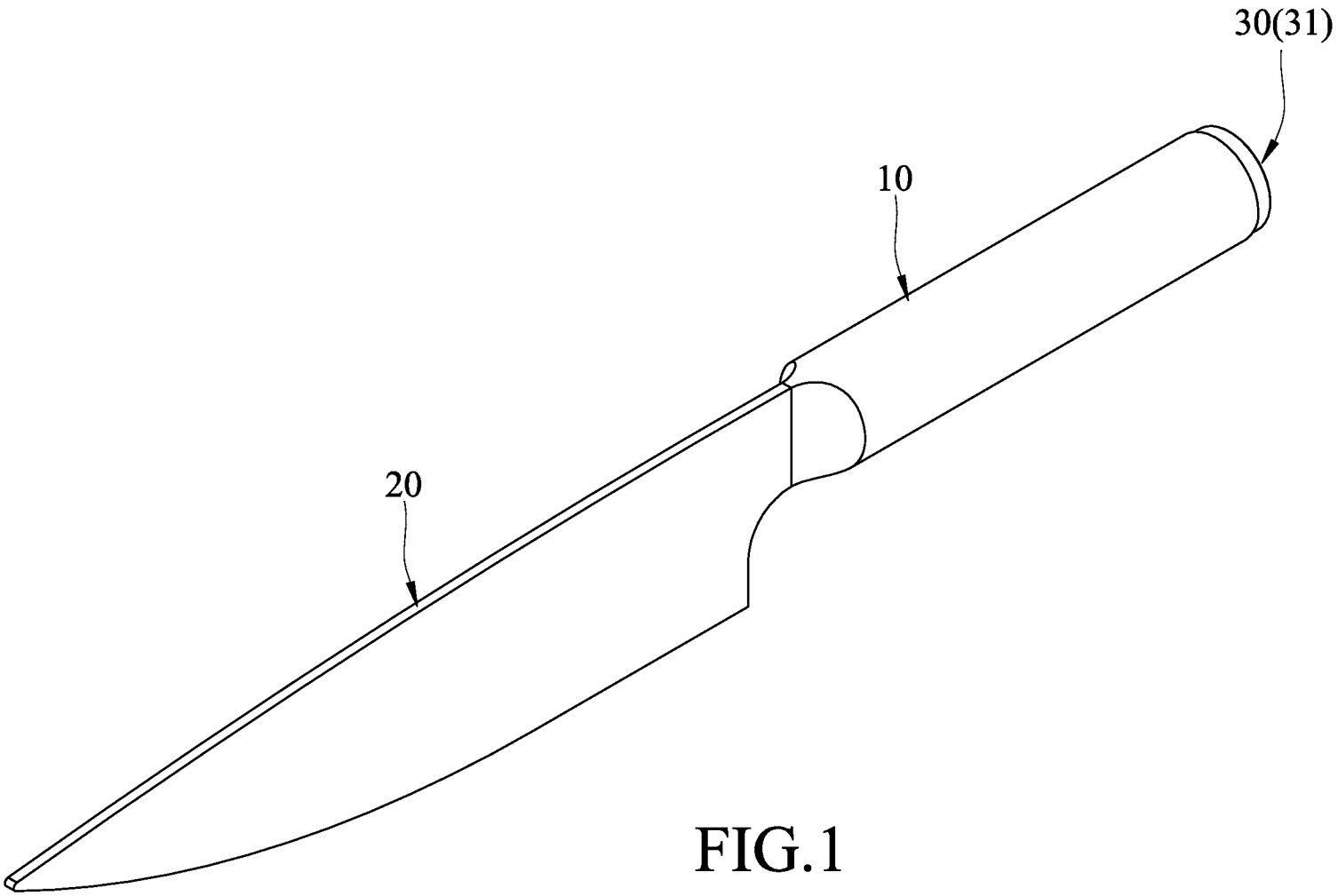
FIG. 1 is a perspective view illustrating an embodiment of a knife according to the disclosure.
Figure 2:
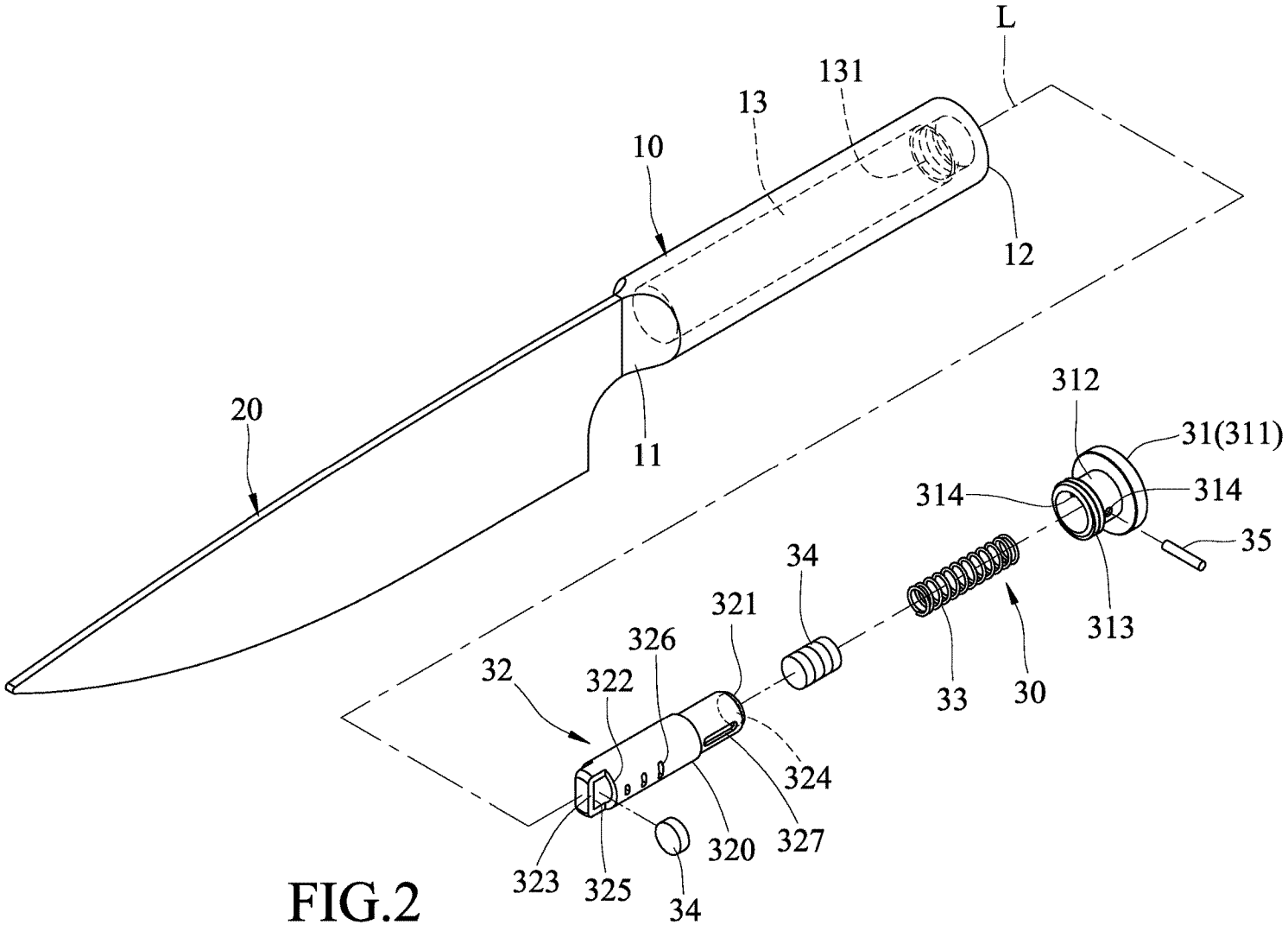
FIG. 2 is a partly exploded perspective view illustrating the embodiment.

Referring to FIGS. 1 and 2, an embodiment of a knife according to the disclosure includes a handle 10, a blade 20, and a counterweight unit 30.

The handle 10 extends along an axis (L), is tubular in shape, and has a front end portion 11, a rear end portion 12 that is opposite to the front end portion 11 along the axis (L), and an accommodating space 13 that extends from the rear end portion 12 toward the front end portion 11. The handle 10 is formed with an internal thread 131 proximal to the rear end portion 12.

The blade 20 is connected to the front end portion 11 of the handle 10.

The counterweight unit 30 includes a cover seat 31, a counterweight-receiving member 32, a pin 35, a plurality of counterweights 34, and a biasing member 33.

The cover seat 31 is removably connected to the rear end portion 12 of the handle 10. The cover seat 31 has a coupling tube 312 and an end cover 311 that is connected to the coupling tube 312. The coupling tube 312 is disposed in the accommodating space 13, and is formed with an external thread 313 threadedly engaging the internal thread 131 of the handle 10. The end cover 311 is connected to the coupling tube 312, and is located outside of the rear end portion 12 of the handle 10 to openably cover the accommodating space 13. The coupling tube 312 has two pin holes 314 that are located between the external thread 313 and the end cover 311, and that are registered with each other in the radial direction.

The counterweight-receiving member 32 is removably disposed in the accommodating space 13, and has a tubular body 320, an abutment wall 323, and a plurality of windows 326.

The tubular body 320 has a connecting end 321 which is connected to the cover seat 31, and a distal end 322 which is opposite to the connecting end 321 along the axis (L). The abutment wall 323 extends from the distal end 322 of the tubular body 320 away from the connecting end 321. Specifically, the abutment wall 323 is U-shaped, has two opposite ends connected to the distal end 322 of the tubular body 320, and cooperates with the tubular body 320 to define a receiving space 324. The abutment wall 323 defines an exit opening 325 that extends in a radial direction perpendicular to the axis (L), and that spatially communicates with the receiving space 324.

The windows 326 are disposed between the connecting end 321 and the distal end 322 of the tubular body 320, and are for seeing the receiving space 324 therethrough in the radial direction when the counterweight unit 30 is separated from the handle 10. In this embodiment, the windows 326 are spaced apart from each other in a direction of the axis (L). In other modification of the embodiment, the counterweight-receiving member 32 may have only one window 326.

The counterweight-receiving member 32 further has two extension slots 327 that are located proximal to the connecting end 321, that are aligned with each other in the radial direction, and that spatially communicates with the receiving space 324. In this embodiment, each of the extension slots 327 is elongated and extends parallel to the axis (L).

The pin 35 extends through one of the pin holes 314, the extension slots 327, and the other one of the pin holes 314 for coupling the counterweight-receiving member 32 to the cover seat 31.

The counterweights 34 are removably disposed in the counterweight-receiving member 32 (i.e., in the receiving space 324). In this embodiment, each of the counterweights 34 has a thickness along the axis (L) which is smaller than a width of the exit opening 325 in a direction parallel to the axis (L).

Figure 3:
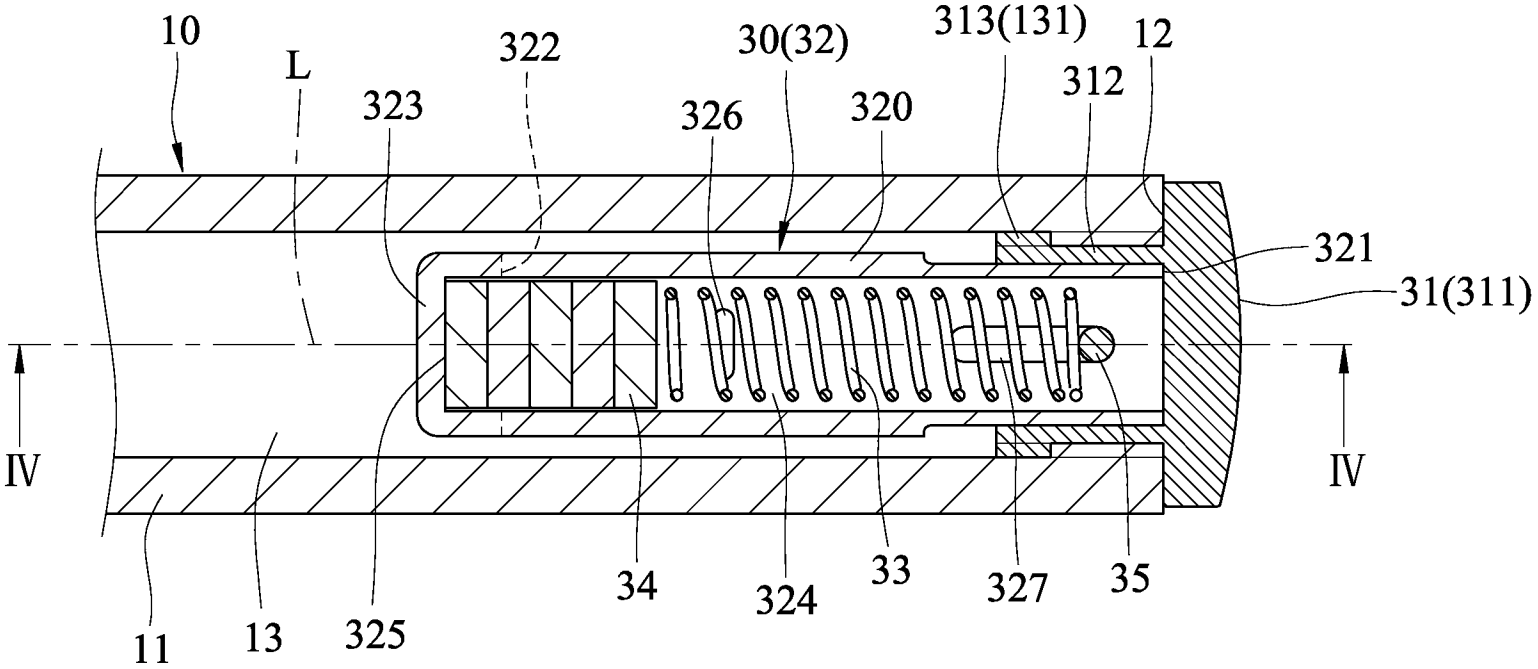
FIG. 3 is a fragmentary sectional view of the embodiment.
Figure 4:
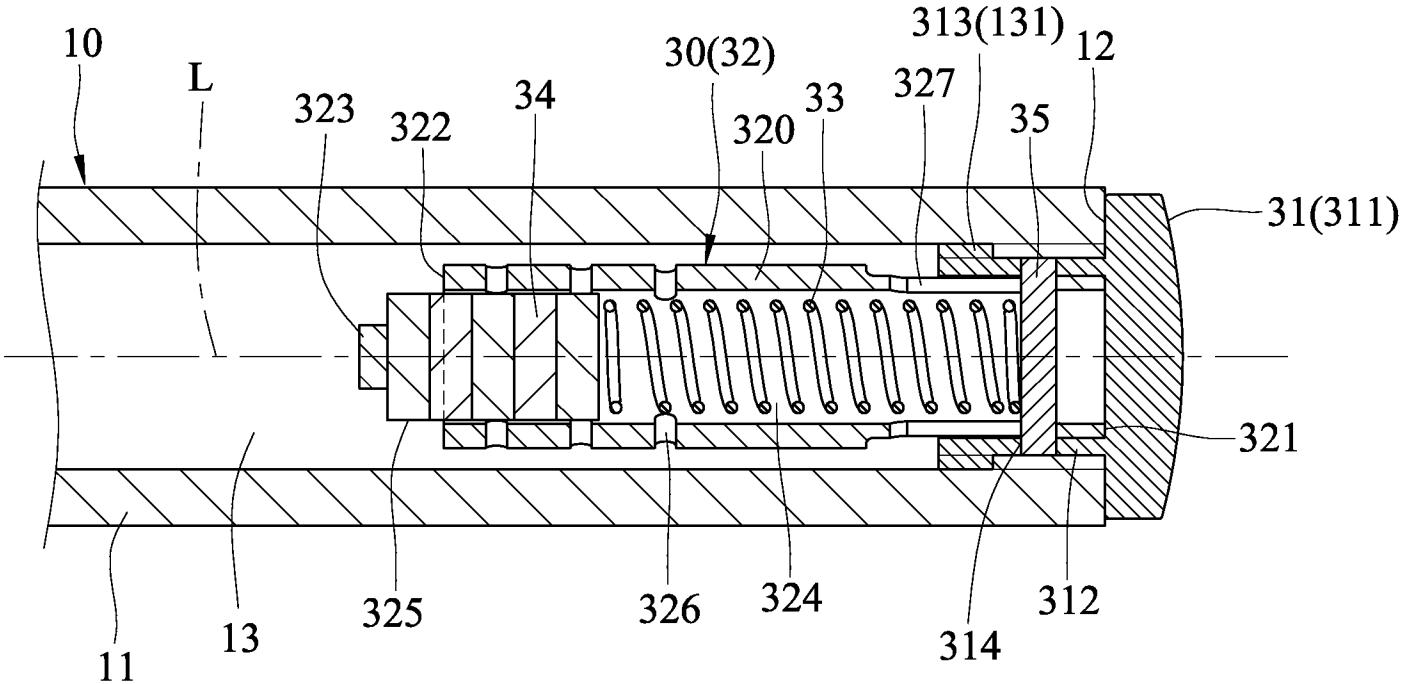
FIG. 4 is a fragmentary sectional view of the embodiment taken along line IV-IV in FIG. 3.

The biasing member 33 is disposed in the counterweight-receiving member 32, and biases the counterweights 34 toward the abutment wall 323 so as to permit removal of one of the counterweights 34 which is adjacent to the abutment wall 323 via the exit opening 325 in the radial direction when the counterweight unit 30 is separated from the handle 10. Specifically, the biasing member 33 has two ends that respectively abut against the pin 35 and the counterweights 34, as shown in FIGS. 3 and 4. In this embodiment, the biasing member 33 is a compression spring.

During assembly, first the counterweights 34 and the biasing member 33 are disposed in the receiving space 324 of the counterweight-receiving member 32. Afterwards, a rod-shaped tool (not shown) is inserted through the two extension slots 327 in the radial direction and is moved along the axis (L) to push the biasing member 33 and the counterweights 34 toward the abutment wall 323, so as to permit the pin 35 to smoothly extend through the extension slots 327 and the pin holes 314 without obstruction of the biasing member 33. After insertion of the pin 35 is completed, the rod-shaped tool can be removed. At this time, the counterweight-receiving member 32 and the cover seat 31 are coupled via the pin 35. As such, the counterweights 34 and the biasing member 33 are securely retained in the receiving space 324, and the counterweights 34 are biased by the biasing member 33 so that one of the counterweights 34 which is adjacent to the abutment wall 323 abuts against the abutment wall 323 and can be taken out of the receiving space 324 via the exit opening 325. The assembly is completed after threadedly engaging the internal thread 131 of the handle 10 with the external thread 313 of the coupling tube 312 of the cover seat 31.

When it is desired to adjust the weight distribution of the knife, first the cover seat 31 is separated from the handle 10 for removing the counterweight unit 30 out of the accommodating space 13, and then a user can take out a desirable number of the counterweights 34 from the receiving space 324 via the exit opening 325. The biasing member 33 biases the remaining ones of the counterweights 34 toward the abutment wall 323. Afterwards, the cover seat 31 can be connected back to the handle 10.

In summary, the knife of this disclosure has the following advantages:

1. By virtue of varying the number of the counterweights 34 in the handle 10, weight distribution of the knife can be adjusted to improve performance of the knife after being repeatedly sharpened.

2. The knife of this disclosure is simple in structure and easy to assemble, and it is relatively easy to adjust the weight distribution of the knife.

3. The counterweight unit 30 is accommodated in the accommodating space 13, thereby providing a neat appearance of the knife.

4. The extension slots 327 are designed to be elongated and extend parallel to the axis (L) for facilitating the assembly of the counterweight-receiving member 32 and the cover seat 31.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A knife comprising:

a handle extending along an axis, and having a front end portion, a rear end portion that is opposite to said front end portion, and an accommodating space that extends from said rear end portion toward said front end portion;

a blade connected to said front end portion of said handle; and a counterweight unit including a cover seat that is removably connected to said rear end portion of said handle, and that openably covers said accommodating space, a counterweight-receiving member that is removably disposed in said accommodating space, and that has a tubular body having a connecting end which is connected to said cover seat, and a distal end which is opposite to said connecting end along the axis, said counterweight-receiving member further having an abutment wall that extends from said distal end of said tubular body away from said connecting end, that cooperates with said tubular body to define a receiving space, and that defines an exit opening extending in a radial direction perpendicular to the axis and spatially communicating with said receiving space, a plurality of counterweights that are removably disposed in said receiving space, and a biasing member that is disposed in said counterweight-receiving member, and that biases said counterweights toward said abutment wall so as to permit removal of one of said counterweights which is adjacent to said abutment wall via said exit opening in the radial direction when said counterweight unit is separated from said handle.

2. The knife as claimed in claim 1, wherein said counterweight-receiving member further has at least one window disposed between said connecting end and said distal end of said tubular body, and for seeing said receiving space therethrough in the radial direction when said counterweight unit is separated from said handle.

3. The knife as claimed in claim 2, wherein said counterweight-receiving member has a plurality of said windows being spaced apart from each other in a direction of the axis.

4. The knife as claimed in claim 1, wherein:

said cover seat has a coupling tube formed with an external thread, and an end cover connected to said coupling tube and located outside of said rear end portion of said handle; and said handle is formed with an internal thread being proximal to said rear end portion of said handle and threadedly engages said external thread of said coupling tube of said cover seat.

5. The knife as claimed in claim 4, wherein:

said coupling tube of said cover seat has two pin holes that are located between said external thread and said end cover, and that are registered with each other in the radial direction;

said counterweight-receiving member further has two extension slots that are located proximal to said connecting end, that are aligned with each other in the radial direction, and that spatially communicates with said receiving space;

said counterweight unit further has a pin that extends through one of said pin holes, said extension slots, and the other one of said pin holes for coupling said counterweight-receiving member to said cover seat; and said biasing member has two ends that respectively abut against said pin and said counterweights.

6. The knife as claimed in claim 5, wherein each of said extension slots is elongated and extends parallel to the axis.

7. The knife as claimed in claim 1, wherein said abutment wall of said counterweight-receiving member is U-shaped and has two opposite ends connected to said distal end of said tubular body.

8. The knife as claimed in claim 1, wherein each of said counterweights has a thickness along the axis which is smaller than a width of said exit opening in a direction parallel to the axis.

* * * * *